United States Patent [19]

Batchelder et al.

[11] 4,215,599

[45] Aug. 5, 1980

[54] TORQUE MULTIPLIER ASSEMBLY

[75] Inventors: Clarence F. Batchelder, El Cajon; Kent B. Casady, San Diego, both of Calif.

[73] Assignee: Khartli, Inc., San Diego, Calif.

[21] Appl. No.: 937,332

[22] Filed: Aug. 28, 1978

[51] Int. Cl.[2] ..... B25B 17/00

[52] U.S. Cl. ..... 81/52.4 R; 81/57.29

[58] Field of Search ..... 81/52.4 R, 52.5, 57.29, 81/57.30, 57.31, 57.13, 57.14

[56] References Cited

U.S. PATENT DOCUMENTS

| | | | |
|---|---|---|---|
| 1,860,871 | 5/1932 | Pouliot | 81/52.5 |
| 2,578,279 | 12/1951 | Bardwell | 81/57.13 |
| 3,124,022 | 3/1964 | Corson | 81/57.29 |
| 3,969,961 | 7/1976 | Amoroso | 81/52.4 R |

*Primary Examiner*—James L. Jones, Jr.
*Attorney, Agent, or Firm*—William C. Babcock

[57] ABSTRACT

A torque multiplier assembly that is portable, compact, and may be easily and conveniently disposed adjacent a nut, bolt or similar threaded elements to removably engage the same. The torque multiplier assembly when so engaged is adapted to exert a first relatively high maximum torque of predetermined value on the nut, bolts or similar elements to initially rotate the same from binding threaded engagement or perform the final tightening of the nut bolt or rotatable element. The torque multiplier assembly is manually actuated by the use of an elongate torque wrench of a type that is commercially available and may be adjusted to supply any one of a number of maximum torque. The desired maximum torque supplied by the elongate torque wrench is relatively low, normally not over fifty foot pounds, and is visually indicated on a calibrated scale that forms a part of the torque wrench. The maximum torque supplied by the torque wrench is transferred to the multiplier assembly, with the torque output of the multiplier assembly being the torque input of the torque wrench multiplied by a factor that is inherent to the specific gear structure of the multiplier assembly.

4 Claims, 7 Drawing Figures

FIG. 1
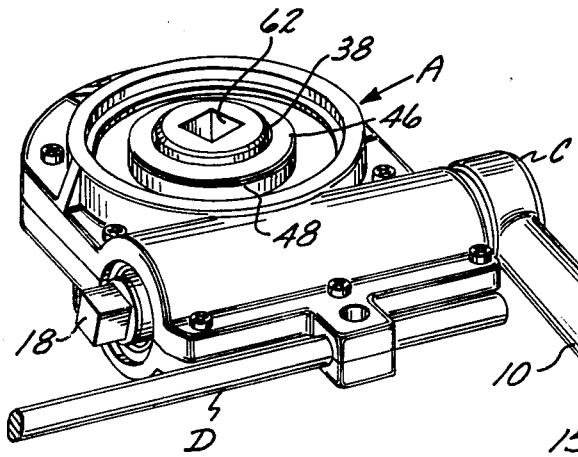
FIG. 2
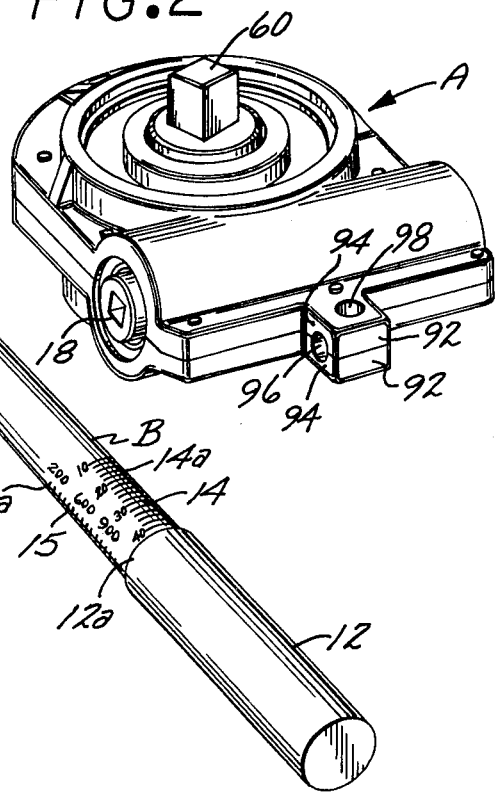
FIG. 3
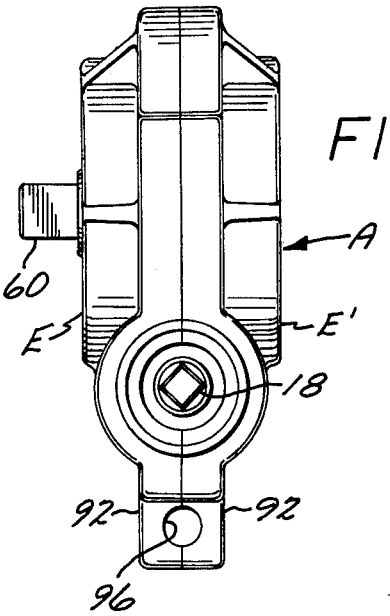
FIG. 4
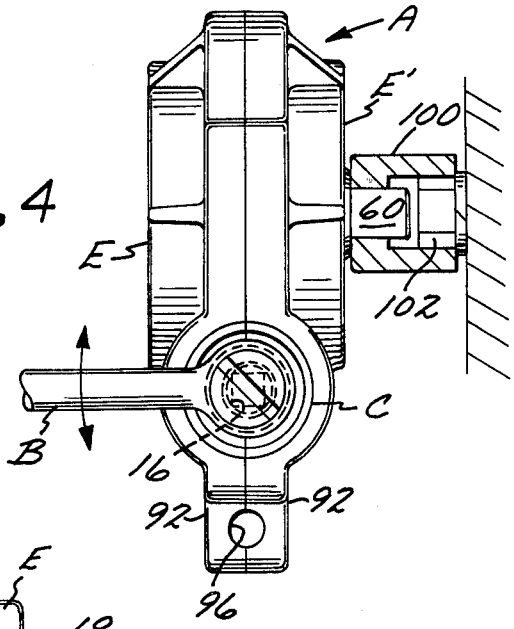
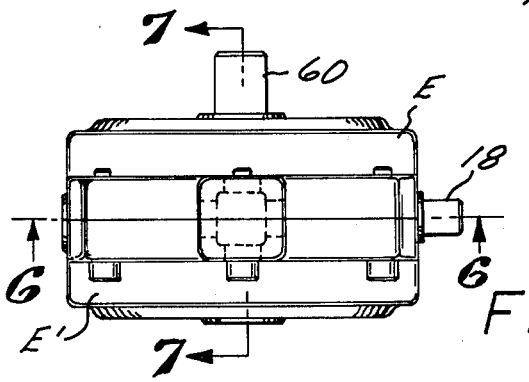
FIG. 5

TORQUE MULTIPLIER ASSEMBLY

BACKGROUND OF THE INVENTION

1. Field of the Invention

Torque multiplier assembly.

2. Description of the Prior Art

In the past, high torque wrench structures have included a gear containing housing to which a rotational force could be applied to slowly turn a driving element that included a torque indicator of the torsion bar type. An example of such a prior art high torque wrench is that described and claimed in my previously issued U.S. Pat. No. 3,564,955 entitled, "High Torque Wrench Assembly", that was granted on Feb. 23, 1971.

Prior art torque wrenches have the operational disadvantages that they are necessarily of heavy construction, are not conveniently moved from place to place, and do not accurately indicate the magnitude of the high torque output thereof, nor do they cease rotating the engaged element when a maximum torque is reached.

A major object of the present invention is to provide a torque multiplier assembly that is capable of exerting the same maximum torque on a nut, bolt head, or other rotatable element, as my prior invention, but one that has the operational advantage that it is more compact, lighter in weight than my prior high torque wrench, and does not require a torque indicating device as a part thereof.

Another object of the invention is to provide a torque multiplier assembly that is actuated by a conventional elongate low torque output wrench that may be manually adjusted to provide any one of a number of maximum torques and the torque output of the present torque multiplier assembly being the torque input of the torque wrench multiplied by a factor that is inherent to the gear structure of the torque multiplier assembly.

Another object of the invention is to provide a torque multiplier assembly that is used only when a relatively torque output is required, and the user of the invention being free to use the lightweight low torque producing wrench in its normal manner when not being used to actuate the torque multiplier assembly.

Yet another object of the invention is to furnish a torque multiplier assembly in which the torque produced thereby may be more accurately determined as to the magnitude thereof than is possible with the torque wrench described in my previous patent, which prior art invention includes a torque indicating device of the torsion bar type.

SUMMARY OF THE INVENTION

A torque multiplier assembly that includes a heavy torque output shaft that has an engaging plug of non-circular transverse cross-section projecting from one end thereof that may engage a socket wrench or other engageable elements that is to be rotated. The opposite end of the shaft has a cavity of non-circular transverse cross-section extending therein, that may removably engage a nut of suitable size and shape or a projecting portion of a rotatable element.

The torque output shaft is key connected in a centered position to a worm gear, which worm gear in turn is in toothed engagement with a worm that is tangentially disposed thereto. The worm gear and worm are rotatably supported by anti-friction bearings within a rigid housing that is preferably of two part structure and removably held together by bolts or the like. The worm has engageable plugs of non-circular transverse cross-section projecting outwardly in opposite directions from the ends thereof, either of which plugs may be removably engaged by a torque imparting end portion of a conventional elongate wrench that is manually adjustable to supply any one of a number of maximum torque to the end portion.

The torque output of the torque multiplier assembly is the torque applied thereto by the torque wrench multiplied by a factor that gives the torque that will be supplied by the shaft of the torque multiplier. The approximate factor which is relatively close may be obtained by a mathematical formula that takes into account the pitch of the teeth on the worm, the number of teeth on the worm and the diameter of the shaft, as well as the diameter of the worm gear, but does not take into account the friction between the worm and worm gear and that of the supporting bearings. The true factor may be obtained by applying a known torque input to the torque multiplier assembly and measuring the torque output. The ratio between the torque output and that of the torque input is the multiplication factor of the invention.

The torque multiplier assembly is actuated by an elongate torque wrench that is manually adjustable to selectively deliver any one of a desired maximum torques, and this type of torque wrench being commercially available. When the multiplication factor is known, the torque output of the torque multiplier assembly is easily determined by multiplying the torque input from the torque wrench by the above-described factor. The torque wrench previously identified is of such structure that when the maximum torque for which it is set is reached the torque wrench is no longer operative for its intended purpose.

BRIEF DESCRIPTION OF THE DRAWING

FIG. 1 is a perspective view of the invention fully illustrating one side thereof, and the view also including a low torque output wrench used in actuating the torque multiplier assembly, as well as a stabilizing bar that may be used to maintain the torque multiplier in a fixed position relative to the rotatable element to which torque is being applied;

FIG. 2 is a second perspective view of the torque multiplier assembly illustrating a second side thereof;

FIG. 3 is an end elevational view of the torque multiplier assembly;

FIG. 4 is a second end elevational view of the torque multiplier assembly with the torque output element removably engaging a socket wrench which, in turn, engages a nut or bolt head of the element that is to be rotated;

FIG. 5 is a front elevational view of the torque multiplier assembly;

DESCRIPTION OF THE PREFERRED EMBODIMENT

The torque multiplier assembly A of the present invention as may best be seen in FIGS. 1, 2, 6 and 7 is actuated by a conventional elongate torque wrench B that has a head C and the wrench being commercially available. The torque multiplier assembly A is preferably held in a stabilized stationary position when imparting torque to a desired rotatable element by use of a stabilizing rod D shown in FIG. 1 or other anchoring means.

Figure 6:
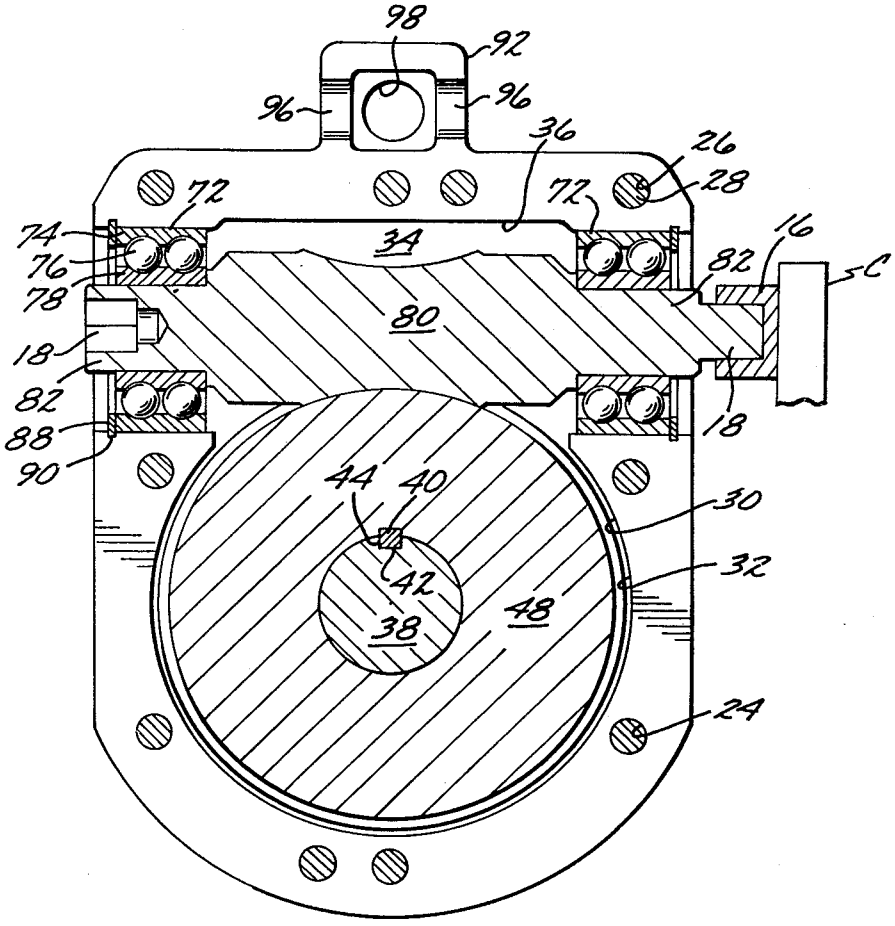
FIG. 6 is a transverse cross-sectional view of the torque multiplier assembly taken on the line 6—6 of FIG. 5.

The torque wrench B includes an elongate handle 10 that has a rotatable portion 12 that moves longitudinally relative the handle as the portion 12 is rotated. The handle 12 has a first scale 14 over which the free edge portion 12*a* of the rotatable portion 12 moves as the handle 10 is rotated. The first scale 4 has numbers 14*a* thereon which indicate the maximum torque that can be applied to a rotatable element by use of the head C. Torque wrenches B of the above-described type are commercially available and are normally designed to provide not over fifty foot pounds of torque through the head C. The head C includes a torque imparting means 16 which may be either a protuberance of non-circular transverse cross-section or a recess that is likewise not of circular transverse cross-section. The torque imparting means 16 as may be seen in FIG. 6 is adapted to removably engage a torque receiving member 18 as shown in FIG. 6 that is of non-circular transverse cross-section, and is a part of the torque multiplier assembly A. The torque wrench B is of such structure that when the maximum torque for which it is set is reached the torque wrench becomes inoperative into far as producing additional torque.

The torque multiplier assembly A as may be seen in the drawings includes first and second housing half portions E and E′ that have first and second abutting surfaces 20 and 22. First and second transverse bores 24 and 26 are formed on the peripheral portions of the housing half portions E and E′, with the second bores having threads on the interior thereof that are engaged by cap screws 28 that serve to hold the two housing half portions in abutting contact.

The first and second housing half portions E and E′ have an opening 30 of substantial diameter extending transversely therethrough, which opening is defined by first circular side walls 32 formed in the first and second housing half portions E and E′. The first and second housing half portions E and E′ have an elongate opening 34 therein that is tangential to the opening 30, with the elongate opening 34 being defined by a second circular side wall within the first and second housing half portion E and E′.

Figure 7:
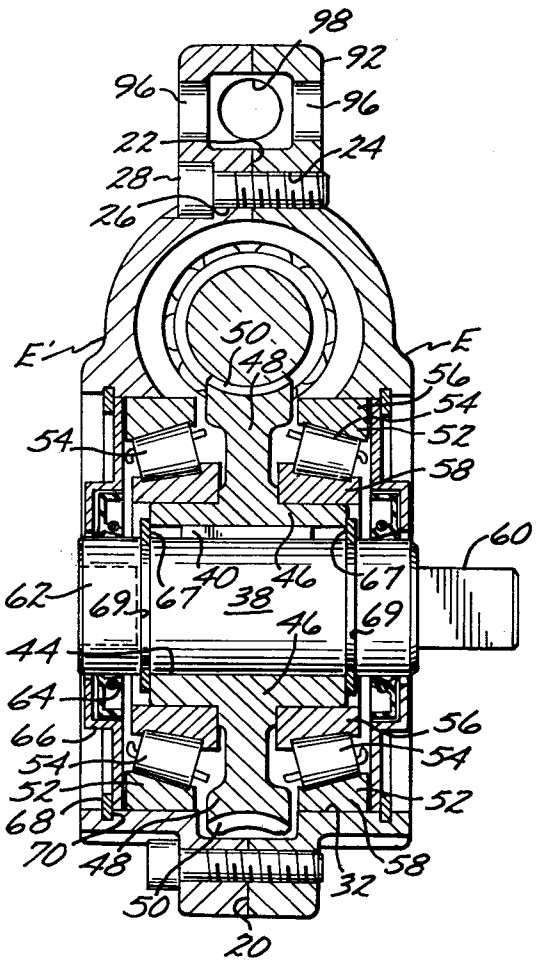
FIG. 7 is a second transverse cross-sectional view of the torque multiplier assembly taken on the line 7—7 of FIG. 5.

A heavy torque output shaft 38 is provided that has a longitudinal slot 42 therein that is engaged by a key 40, with the key also engaging a radially aligned slot 44 formed on the interior surface of a cylindrical hub 46 of a worm gear 48 as shown in FIGS. 6 and 7. The worm gear 48 has teeth 50 on the outer periphery thereof.

A pair of laterally spaced anti-friction roller bearing assemblies 52 are provided, each of which assemblies includes a number of tapered rollers 54 that rotatably engage a bearing cup 56 and bearing cone 58. The shaft 38 as may best be seen in FIG. 7 has a torque output plug 60 of non-circular transverse cross-section projecting outwardly from one end thereof and a torque output recess 62 extending into the shaft 38 from the opposite end thereof.

A pair of oil seals 64 are disposed within the first and second housing portions E and E′ as shown in FIG. 7 to encircle the shaft 38, with the oil seals being removably held in position within the housing portion by a pair of retainer seals 66. A pair of retainer rings 68 are provided that abut against the retainer seals 66, and the retainer rings removably engaging grooves 70 that extend into the first circular side wall 32. The worm gear 48 is held in a fixed longitudinal position on the shaft 38 by a pair of transversely spaced retainer rings 67 that engage grooves 69 formed in the shaft 38.

A pair of laterally spaced, anti-friction ball bearing assemblies 72 are provided, with each assembly including an outer race 74, inner race 78 and a number of balls 76 situated therebetween. A worm 80 is provided that has cylindrical end portions 82, with each of the end portions being rotatably supported by the inner races 78 of the anti-friction ball bearing assemblies 72. The worm 80 and the anti-friction ball bearing assembly 72 as can best be seen in FIG. 6 are mounted in the elongate opening 34 defined between the first and second housing half portions E and E′.

A torque receiving plug 18 projects outwardly from one end of the worm 80, which plug is of non-circular transverse cross-section. A torque receiving cavity 18 extends inwardly into an opposite end of the worm 80. The ball bearing assembly 72 as may best be seen in FIG. 6 are maintained in a fixed position within the first and second housing half portions E and E′ by a pair of longitudinally spaced ring-shaped retainers 88 that engage circular grooves 90 formed in the half housing portions.

Two transversely aligned lugs 92 project outwardly from the half housing portions E and E′ as shown in FIGS. 6 and 7, with each lug having a semi-circular groove 94 extending therethrough, with the grooves cooperating to provide a first cylindrical opening 96. The first opening 96 may be removably engaged by the stabilizing rod B as shown in FIG. 1. The pair of lugs 92 also have transversely and axially aligned second openings 98 therein, which openings may be engaged by a chain or the like (not shown) to hold the torque multiplier assembly A in a substantially stationary position during the time that it is being used to supply torque through the plug 60 or recess 62 shown in FIG. 7. In FIG. 4 the plug 60 is shown in removable engagement with a conventional socket wrench 100, which wrench 100 is in turn in engagement with a nut or bolt head 102 to which it is desired to impart a high torque either in loosening or rotating the same.

The elongate torque wrench B has a longitudinally extending first numbered scale 14 thereon over which the rotatable portion 12 moves as the latter is rotated, with the free edge portion 12*a* of the portion 12 when transversely aligned with a graduation of scale 14 indicating the maximum torque in foot pounds that can be delivered by the torque wrench B. The graduations 14 have numbers 14*a* imprinted on the handle B that indicate the magnitude of the torque.

The handle B preferably has a second longitudinal scale 15 thereon opposite the scale 14, with numbers 15*a* of the seocnd scale indicating the torque output of the torque multiplier assembly A. Each number 15*a* is obtained by multiplying the number 14*a* opposite thereof by the factor previously described. Once the factor has been determined it may be used to obtain all of the torque output numbers on the second scale 15, for the friction between the gears and bearing assemblies will not vary appreciably over the entire range of the low torque input to the multiplier assembly A.

The torque wrench B may be used individually over the entire low torque range thereof in a conventional manner. When a higher torque is required the torque multiplier assembly A is placed in direct engagement with a socket wrench as shown in FIG. 4 to apply a desired high torque to a nut or bolt head 102. The torque multiplier assembly A is held in a non-rotatable position relative to the nut or bolt head 102 by use of the stabilizer rod D, or a chain or restraining element (not shown) that extends through openings 98 and is secured to a suitable anchor. The torque wrench B is now placed in operative engagement with the multiplier assembly A, and the wrench portion 12 rotated for it to move longitudinally on the handle 10 until the free edge 12*a* thereof is transversely aligned with the graduation 15 that indicates the maximum torque output that will be exerted by the plug 60 or recess 62 when the torque wrench is exerting the maximum torque input 14*a* for which it is set. The torque wrench B exerts torque on torque multiplier assembly A by being pivoted upwardly and downwardly relative thereto as shown in FIG. 4.

The torque multiplier assembly A is illustrated as having a projecting torque receiving member 18 of non-circular transverse cross-section on one end of worm 80 and a torque receiving recess 18 on the opposite end thereof, each of which may receive input torque from the torque input member 16 of head C of torque wrench B. The direction of rotation of torque output plug 60 is controlled by changing the direction in which torque is imparted to worm 80 by torque wrench B. From the prior description of torque multiplier assembly A it will be apparent that lubricant may be disposed within the housing portions E and E′, and retained therein by the oil seals 64.

The use and operation of the torque multiplier assembly A has been previously described in detail and need not be repeated.

What is claimed is:

1. In combination with an elongate torque wrench of the type that has a head, an elongate handle extending from said head, engageable torque input means on said head, manually adjustable means on said handle that limit the maximum torque said torque input means are concurrently rotated, a first numbered scale on said handle that is so operatively associated with said adjustable means as to visually indicate the particular maximum torque input for which said torque wrench is set, a torque multiplier assembly capable of exerting a predetermined maximum torque on a rotatable element, said torque multiplier including:

a. a shaft of substantial diameter and strength that is capable of withstanding the greatest of said maximum torques;

b. a worm gear that includes a cylindrical hub of less length than said shaft, said hub having said shaft extending therethrough, said worm gear centered on said shaft and said worm gear having first teeth on the periphery thereof;

c. first means for connecting said worm gear to said shaft to cause said worm gear and shaft to rotate as an integral unit;

d. a worm tangentially disposed to said worm gear, said worm including second teeth of spiral configuration that mesh with said first teeth, said worm gear having oppositely disposed cylindrical end portions;

e. torque receiving means on said end portions that removably engage said torque input means;

f. a substantially square housing having a depth substantially less than the length thereof, said housing having an opening therein which said worm gear is disposed and a second elongate opening tangential to said first opening in communication with the latter, said second opening having said worm therein, said housing having a generally flat side surface that may be disposed adjacent the element that is to be rotated;

g. a pair of laterally spaced first bearing assemblies, each of said first bearing assemblies including a first ring-shaped member that engages an exterior end portion of said hub, a second ring-shaped member that engages said housing, and a plurality of rotatable elements disposed between said first and second ring-shaped members;

h. a pair of laterally spaced oil seals mounted on said shaft adjacent said hub for maintaining lubricant within said housing;

i. second means for maintaining said oil seals in fixed positions relative to said housing;

j. a pair of laterally spaced second bearing assemblies, each of said second bearing assemblies including an inner race that engages said housing, and a plurality of rotatable elements between said first and second races;

k. torque output means on the ends of said shaft for transferring any desired one of a plurality of maximum torque outputs to an element that is to be rotated, with each of said maximum torque outputs being a multiple of one of said maximum torque inputs; and l. a second numbered scale on said handle that is so operatively associated with said adjustable means as to visually indicate the maximum torque that will be provided by said torque output means when said torque input means is in engagement with said torque receiving means and said torque wrench is actuated to rotate said torque input means.

2. A torque multiplier assembly as defined in claim 1 in which said torque output means is a plug of non-circular transverse cross-section that projects from a first end of said shaft.

3. A torque multiplier assembly as defined in claim 2 in which said torque output means is a recess of non-circular transverse cross-section that extends into said shaft from a second end thereof.

4. A torque multiplier assembly as defined in claim 1 in which said manually adjustable means is an elongate member that moves longitudinally on said handle when it is manually adjusted to provide a desired torque input from said torque wrench, and the free edge of said member most adjacent said head when transversely aligned with graduations on said first and second scales visually indicating the torque input from said torque wrench and the torque output from said torque multiplier assembly.

* * * * *